US011524885B2

(12) United States Patent
Walton et al.

(10) Patent No.: US 11,524,885 B2
(45) Date of Patent: Dec. 13, 2022

(54) VALVE CLOSURE WITH CONCENTRIC SPRING-LOADED MOVING VALVE MEMBERS, THE INTERNAL VALVE MEMBER HAVING AXIAL PROTRUSIONS

(71) Applicants: Philip Andrew Walton, Bishop Auckland (GB); Sergio Sonzogni, Bergamo (IT)

(72) Inventors: Philip Andrew Walton, Bishop Auckland (GB); Sergio Sonzogni, Bergamo (IT)

(73) Assignee: POLYKEG S.R.L.

( * ) Notice: Subject to any disclaimer, the term of this patent is extended or adjusted under 35 U.S.C. 154(b) by 0 days.

(21) Appl. No.: 17/418,835

(22) PCT Filed: Dec. 31, 2019

(86) PCT No.: PCT/GB2019/053709

§ 371 (c)(1),
(2) Date: Jun. 27, 2021

(87) PCT Pub. No.: WO2020/141320

PCT Pub. Date: Jul. 9, 2020

(65) Prior Publication Data

US 2022/0073333 A1 Mar. 10, 2022

(30) Foreign Application Priority Data

Jan. 1, 2019 (GB) ..... 1900002

(51) Int. Cl.

| | |
|---|---|
| ***B67D 1/08*** | (2006.01) |
| ***B67D 1/04*** | (2006.01) |
| ***B67D 1/00*** | (2006.01) |

(52) U.S. Cl.
CPC ..... *B67D 1/0832* (2013.01); *B67D 1/04* (2013.01); *B67D 2001/0093* (2013.01)

(58) Field of Classification Search
CPC . B67D 1/0832; B67D 1/04; B67D 2001/0093
See application file for complete search history.

(56) References Cited

U.S. PATENT DOCUMENTS 86,196 A * 1/1869 Windle et al. ..... B67D 1/0832 217/100
3,353,724 A * 11/1967 Johnston ..... B67D 1/0832 137/212

(Continued)

FOREIGN PATENT DOCUMENTS

| | | |
|---|---|---|
| EP | 2014608 | 4/2009 |
| GB | 2446396 | 3/2008 |
| WO | WO 00/07902 | 7/2000 |

*Primary Examiner* — Jeremy Carroll
(74) *Attorney, Agent, or Firm* — Galbreath Law Offices, P.C.; John A. Galbreath

(57) ABSTRACT

A valve closure for dispensing liquid by means of a pressurised gas has an inner sleeve (12) which includes a socket (16) and an annular inner valve seat (18). The inner sleeve carries a ring seal (14) which is urged against an outer valve seat (9) by an outer spring (15). A valve member (21) has an annular sealing face (23) co-operable with the inner valve seat (18) and a spring (24) urges the valve member (21) against the inner valve seat (18). The valve member (21) incorporates a plurality of projections (26) spaced radially from the annular sealing face (23). The valve closure can be used with a dispensing coupler having a tubular probe with a circumferential ring seal and a locking recess to engage the locking fingers of a detachable closing element.

12 Claims, 4 Drawing Sheets

(56) References Cited

U.S. PATENT DOCUMENTS

| | | | | | |
|---|---|---|---|---|---|
| 3,422,448 | A | | 1/1969 | Johnston | |
| 3,591,058 | A | * | 7/1971 | Johnston | B67D 1/0832 222/400.7 |
| 3,599,843 | A | | 8/1971 | Johnston | |
| 4,180,189 | A | * | 12/1979 | Zurit | B67D 1/0832 137/212 |
| 2021/0229972 | A1 | * | 7/2021 | Covi | F16F 1/028 |

* cited by examiner

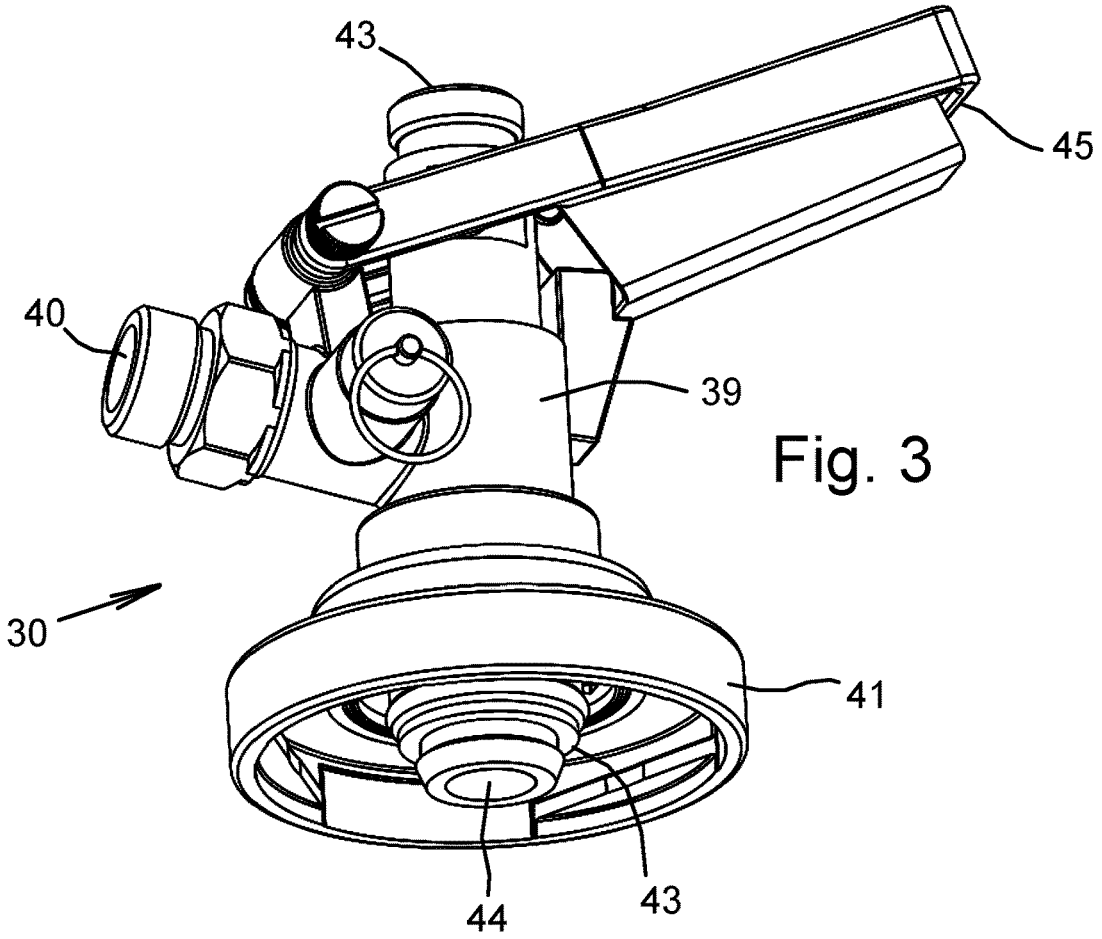
Fig. 3
Fig. 4
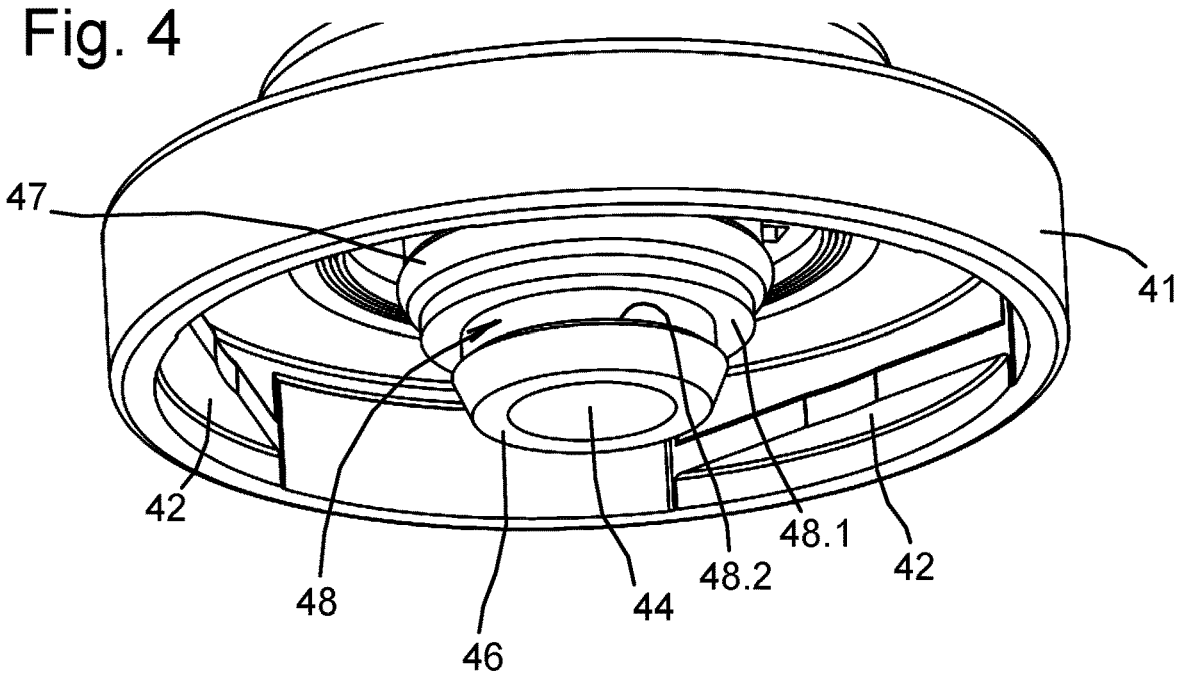

VALVE CLOSURE WITH CONCENTRIC SPRING-LOADED MOVING VALVE MEMBERS, THE INTERNAL VALVE MEMBER HAVING AXIAL PROTRUSIONS

TECHNICAL FIELD OF THE INVENTION

This invention relates to valve closures for dispensing liquids, particularly (but not exclusively) carbonated beverages such as beer.

BACKGROUND

Kegs containing carbonated beverages are under internal pressure which is is dependent on the level of carbonation (amount of dissolved $CO_2$) and the temperature of the beverage. Furthermore, some beer brewers use a post-fermentation process where fermentation and hence $CO_2$ generation can continue after initial filling. Kegs may also be used for non-carbonated beverages; in this case, the internal pressure is introduced only during the dispensing phase. Such containers are provided with a valve closure which, prior to dispensing, seals the liquid beverage inside the container along with any pressurised gas. When a suitable dispensing coupler is connected to the valve closure the valve is operated to open a liquid path for the product. At the same time, a separate gas path is opened through which a gas can be fed into the container to dispense the liquid.

Many different kinds of valve closure currently exit, common valve formats being A, G, S, D and M types. An A-type valve is similar to a G-type valve. Both have a fixed central core pin and a single spring-loaded valve member which controls two ports. Operationally, S, D and M types are similar to each other in that they all have no fixed central core pin but have two concentric spring-loaded moving valve members which separately control the two ports. Generally the valve members are operated by respective spring elements, but the valve members may be cascaded such that closure of one spring-loaded valve member causes closure of the other.

Generally speaking, each valve format requires the use of a different dispensing coupler. One particular coupler has a sliding probe with a distal end that is specifically designed to lock onto a detachable closing element, but this kind of coupler cannot be used to dispense from any of the standard valve formats.

A further form of valve closure as disclosed in U.S. Pat. No. 3,353,724 has a spring-loaded valve member to control the liquid flow path which incorporates a generally U-shaped actuator stem. The stem consists of a pair of spaced legs which are notched at their upper ends to form shoulders for receiving the lower end of a coupler probe. When the dispensing coupler is connected, the probe slides over the upper end of the actuator stem and engages the notches to drive the valve member downwardly and opens the liquid flow path. Again, this form of dispensing coupler is specific to the kind of valve closure described.

SUMMARY OF THE INVENTION

When viewed from one aspect the present invention proposes a valve closure when used in combination with a dispensing coupler:— the valve closure having:

an inner sleeve (12) which includes a socket (16) and an annular inner valve seat (18);

a valve member (21) having an annular sealing face (23) co-operable with the inner valve seat (18);

spring means (24) urging the valve member (21) against the inner valve seat (18);

wherein the valve member (21) incorporates a plurality of projections (26) spaced radially inwards from the annular sealing face (23) and projecting towards the socket (16);

the dispensing coupler having:

a housing (39);

a tubular probe (43) slidably received within the housing, the tubular probe having a central bore (44);

wherein a distal end of the tubular probe (43) has an end face (46), a circumferentially-extending ring seal (47), and a circumferential locking recess (48) disposed between the ring seal (47) and the end face (46) to engage a detachable closing element.

In a preferred embodiment the valve member (21) incorporates at least three projections (26).

In a preferred embodiment a lower end of the socket (16) is defined by an inwardly directed shoulder (17) which provides the inner valve seat (18).

In a preferred embodiment the height of the projections (26) measured axially of the inner sleeve (12) is less than the axial length of the shoulder (17) at the lower end of the socket (16).

In a preferred embodiment the inner sleeve (12) is disposed within an outer sleeve (10) adapted (2, 4) to engage the neck of a container.

In a preferred embodiment the outer sleeve (10) is connected to an annular top wall (6) forming an outer valve seat (9).

In a preferred embodiment the inner sleeve (12) is provided with a ring seal (14) co-operable with the outer valve seat (9).

In a preferred embodiment outer spring means (15) urges the inner sleeve (12) towards the outer valve seat (9).

In a preferred embodiment an outer periphery (7) of the annular top wall (6) projects radially outwards and has a plurality of circumferential notches (8).

In a preferred embodiment the circumferential locking recess (48) has opposing upper and lower faces (48.1 and 48.2).

In a preferred embodiment the upper face (48.1) of the locking recess (48) is wider than the lower face (48.2) and projects radially outwards beyond the lower face.

In a preferred embodiment the housing (39) has a gas inlet port (40).

In a preferred embodiment the dispensing coupler has a bayonet fitting (41) to engage the valve closure.

BRIEF DESCRIPTION OF THE DRAWINGS

The following description and the accompanying drawings referred to therein are included by way of non-limiting example in order to illustrate how the invention may be put into practice. In the drawings:

FIG. 3 is a general view of a known dispensing coupler with which the valve closure can be used;

FIG. 4 is an enlarged detail of a lower end of the dispensing coupler;

DETAILED DESCRIPTION OF THE DRAWINGS

Figure 1:
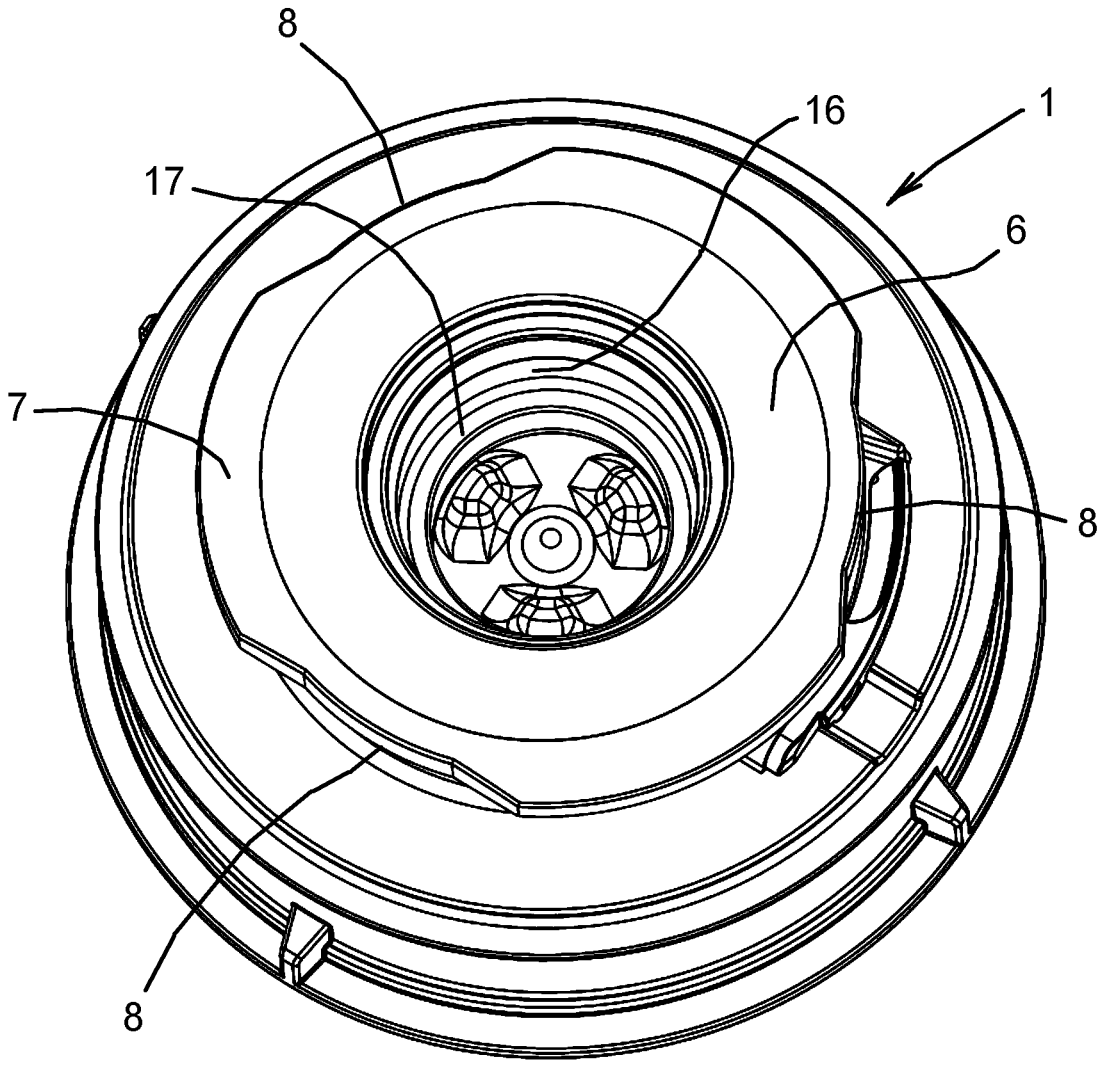
FIG. 1 is a general top view of a valve closure.
Figure 2:
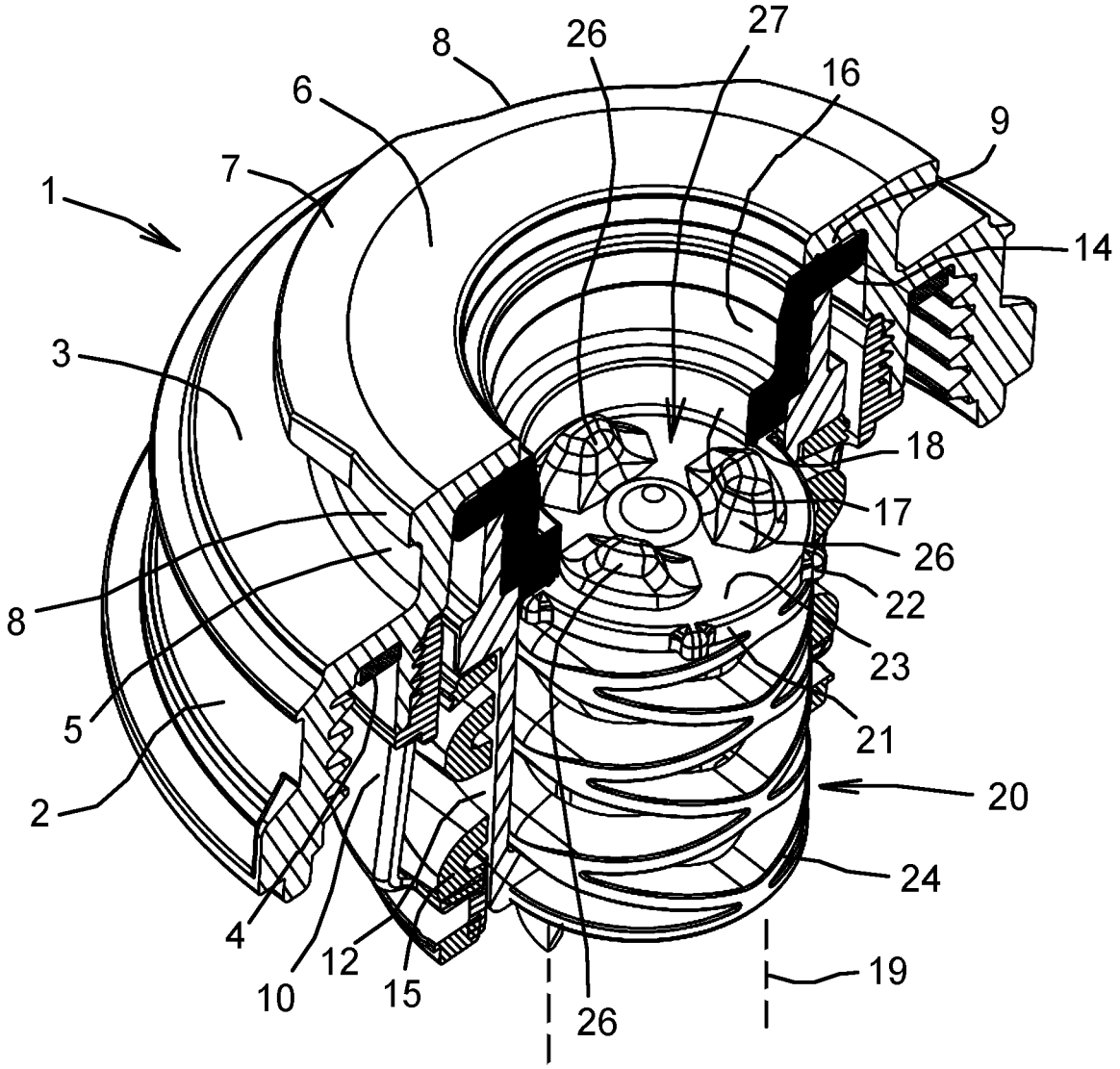
FIG. 2 is another general view of the valve closure which is partially sectioned.

The valve closure V which is shown in FIGS. 1 and 2 comprises a closure body 1 which is adapted to be fitted onto the neck of a beverage container such as a beer keg (not shown), which is typically formed by stretch blow moulding. All components of the valve closure may be moulded of polymeric materials (plastics) so that the closure is fully recyclable. An example of such a valve closure is described in EP 2 585 400 A1. As can be seen in FIG. 2, the closure body 1 has an internally threaded cylindrical side wall 2 for screw-engagement with the neck of the container, and an annular end wall 3 which may include a sealing ring 4 for sealing contact with the neck of the container. A short cylindrical connecting wall 5 extends upwardly from the inner edge of the end wall 3 to join an annular top wall 6. An outer periphery of the top wall 6 projects beyond the connecting wall 5 to form a connecting flange 7 which typically has three circumferentially-spaced notches 8 for engagement by a dispensing coupler of the kind described below. The inner periphery of the top wall 6 forms an outer valve seat 9. Spaced inwardly of the side wall 2, an outer sleeve 10 is engaged with the top wall 3 for reception within the neck of the container.

An inner sleeve 12 forming an outer valve member includes a resilient ring seal 14 and is spring-loaded by an outer spring 15 located within the outer sleeve 10 to sealingly urge the ring seal 14 against the outer valve seat 9. An upper end of the inner sleeve 12 forms an cylindrical socket 16 which is accessible through the annular top wall 6. (See FIG. 2.) A lower end of the socket 16 is defined by an inwardly directed shoulder 17 which provides an inner valve seat 18. A draw tube, indicated at 19, may be connected to the bottom end of the sleeve 12 for removing liquid from the container. An inner valve member 20 is mounted inside the lower end of the sleeve 12. The valve member has a disc-shaped head 21, formed with peripheral guide projections 22, which provides an annular valve face 23. An inner spring 24, which is preferably integrally formed as part of the valve member 20, urges the annular valve face 23 into sealing contact with the inner valve seat 18, the lower end of this spring bearing against the bottom of the inner sleeve 12. The head 21 of the valve member also includes a plurality of upstanding projections 26 which are spaced inside the annular valve face 23 to project through the shoulder 17 towards the socket 16. The projections 26 are circumferentially spaced apart by intervening gaps 27. It will be noted that the height of the projections 26 measured axially of the inner sleeve 12 is less than the axial length of the shoulder 17 at the lower end of the socket 16. At least three such upstanding projections 26 are preferred to ensure that the valve member is not likely to tilt and jam during opening.

To dispense a liquid product from the container the valve member 6 is engaged by a known dispensing coupler 30 of the kind which is shown in FIGS. 3 and 4. The dispensing coupler includes a housing 39 with a gas inlet port 40. The coupler can be connected to a suitable valve closure by means of a bayonet fitting 41 formed with three internal flanges 42. A tubular probe 43 with a central bore 44 is received within the housing 39, such that the probe can be axially moved within the housing by means of a pivotable handle 45. The proximal end of the probe 43 which is remote from the valve closure in use, forms a liquid dispensing port. As can be seen in FIG. 4, the distal end of the probe 43 has an annular end face 46, and carries a circumferentially-extending ring seal 47 which, when the coupler is connected with a valve closure, forms a fluid seal with the closure enabling liquid to flow out of the container through the bore 44. Between the ring seal 47 and the end face 46 the probe has a circumferential locking recess 48 which is intended to receive locking fingers on a detachable closing element incorporated in another form of valve closure. The locking recess 48 is configured to lock onto the fingers in use, with opposing upper and lower faces 48.1 and 48.2. It will be noted that the upper face 48.1 is wide than the lower face 48.2 to project radially outwards beyond the lower face.

Figure 5:
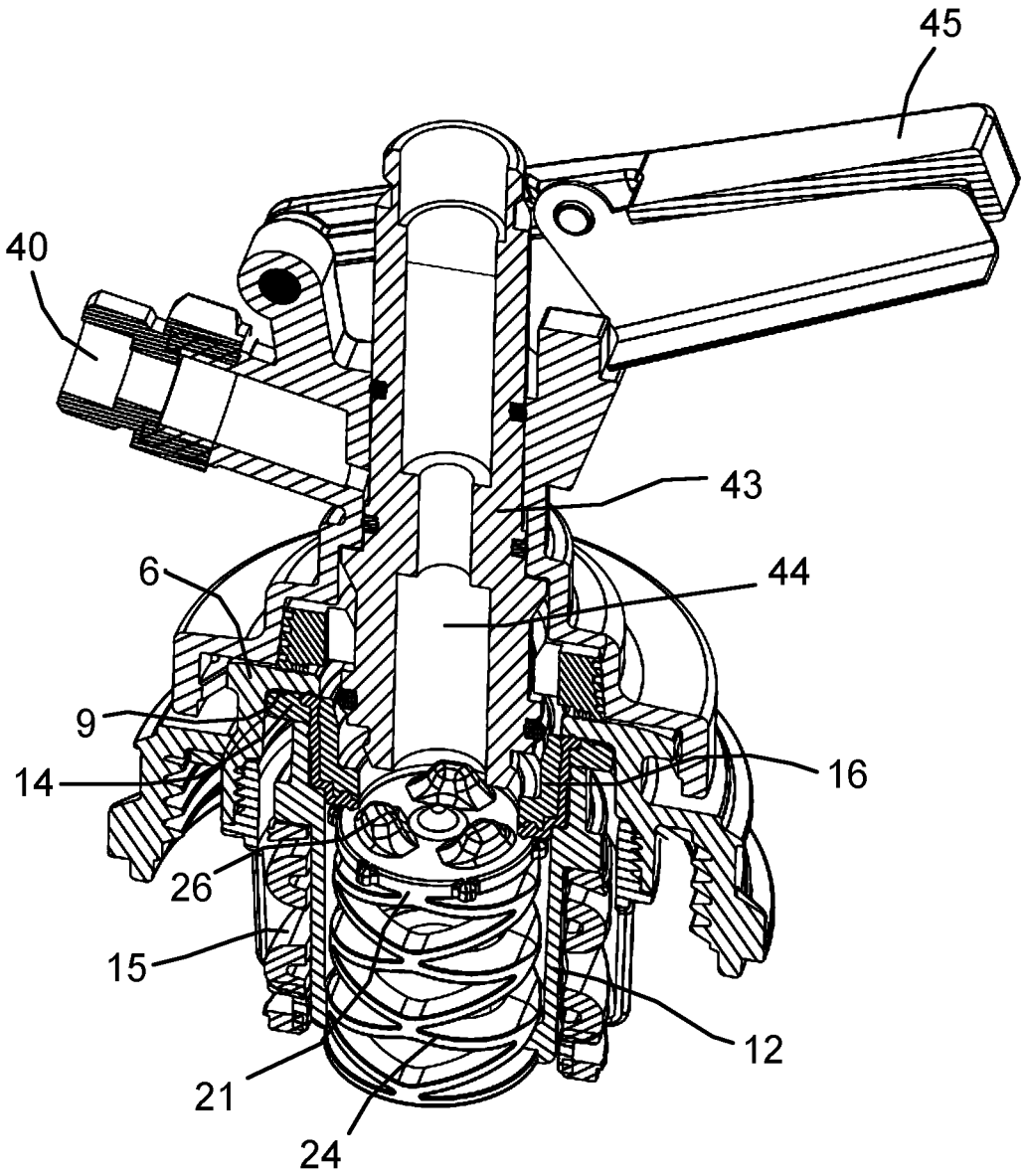
FIG. 5 is general view of the dispensing coupler engaged with the valve closure, both shown partially in axial section.

To dispense liquid from the container the bayonet fitting 41 is engaged with the annular top wall 6 of the present valve closure—see FIG. 5. The handle 45 is then pivoted to advance the probe 43 into the socket 16 of the inner sleeve 12 wherein the ring seal 47 makes sealing contact with the socket. As the probe advances further into the socket the distal end face 46 contacts the projections 26 urging the valve head 21 to move out of contact with the inner valve seat 18 against the action of the inner spring 24. The projections 26 do not enter the liquid flow path within the central bore 44, thus maintaining an unrestricted flow path through the bore. At the same time, the upper face 48.1 of the locking recess 48 engages the top of the shoulder 17 of the inner sleeve 12. The downward force of the probe acting on the inner sleeve 12 thus causes the sleeve 12 to move against the upward action of the outer spring 15, moving the ring seal 14 away from the outer valve seat 9.

The opening of the valve closure by the dispensing coupler 30 thus opens up separate gas and liquid flow paths through the valve closure. Pressurised gas is fed into the container through the gas inlet port 40, along the outside of the probe 43, between the ring seal 14 and the outer valve seat 9, entering the container through the lower end of the outer sleeve 10. Liquid simultaneously flows out of the container through the draw tube 19, flowing between the valve head 21 and the inner valve seat 18 and passing into the probe 43 through the gaps between the projections 26. When dispensing is finished the dispensing coupler is disconnected, so that the inner sleeve 12 and the valve member 20 both return to their sealing positions, holding the internal gas pressure within the container along with any remaining liquid.

The present valve closure can be used with existing dispensing couplers intended to operate S, D and M type closures as well as couplers of the kind described which are intended to engage the locking fingers of a closing element. Reliable connection, dispensing, and closing of the valve, along with improved liquid flow characteristics, can be obtained with the present valve closure. Similarly, the dispensing coupler can be used with the present valve closure, or those with a detachable closing element, without modification.

In bag-in-keg containers the liquid product is held within an inner flexible bag formed of a thin impermeable non-structural membrane which is sealingly joined, e.g. by welding, to an adapter which is connected to the outer sleeve 10. During dispensing the pressurised gas is fed into the space between the flexible bag and the outer container.

Whilst the above description places emphasis on the areas which are believed to be new and addresses specific problems which have been identified, it is intended that the features disclosed herein may be used in any combination which is capable of providing a new and useful advance in the art.

The invention claimed is:

1. A valve closure in combination with a dispensing coupler configured to operate the valve closure:— the valve closure having:

an inner sleeve (12) which includes a socket (16) and an annular inner valve seat (18);

a valve member (21) having an annular sealing face (23) co-operable with the inner valve seat (18);

spring means (24) urging the valve member (21) against the inner valve seat (18);

wherein the valve member (21) incorporates a plurality of projections (26) spaced radially inwards from the annular sealing face (23) and projecting towards the socket (16);

the dispensing coupler having:

a housing (39);

a tubular probe (43) slidably received within the housing, the tubular probe having a central bore (44);

wherein a distal end of the tubular probe (43) has an end face (46), a circumferentially-extending ring seal (47), and a circumferential locking recess (48) disposed between the ring seal (47) and the end face (46) to engage a detachable closing element;

wherein the circumferential locking recess (48) has opposing upper and lower faces (48.1 and 48.2).

2. A valve closure and dispensing coupler according to claim 1 wherein the valve member (21) incorporates three projections (26).

3. A valve closure and dispensing coupler according to claim 1 wherein a lower end of the socket (16) is defined by an inwardly directed shoulder (17) which provides the inner valve seat (18).

4. A valve closure and dispensing coupler according to claim 3 wherein the height of the projections (26) measured axially of the inner sleeve (12) is less than the axial length of the shoulder (17) at the lower end of the socket (16).

5. A valve closure and dispensing coupler according to claim 1 wherein the inner sleeve (12) is disposed within an outer sleeve (10) adapted (2, 4) to engage the neck of a container.

6. A valve closure and dispensing coupler according to claim 5 wherein the outer sleeve (10) is connected to an annular top wall (6) forming an outer valve seat (9).

7. A valve closure and dispensing coupler according to claim 6 wherein the inner sleeve (12) is provided with a ring seal (14) co-operable with the outer valve seat (9).

8. A valve closure and dispensing coupler according to claim 6 wherein outer spring means (15) urges the inner sleeve (12) towards the outer valve seat (9).

9. A valve closure and dispensing coupler according to claim 6 wherein an outer periphery (7) of the annular top wall (6) projects radially outwards and has a plurality of circumferential notches (8).

10. A valve closure and dispensing coupler according to claim 1 wherein the upper face (48.1) of the locking recess (48) is wider than the lower face (48.2) and projects radially outwards beyond the lower face.

11. A valve closure and dispensing coupler according to claim 1 wherein the housing (39) has a gas inlet port (40).

12. A valve closure and dispensing coupler according to claim 1 wherein the dispensing coupler has a bayonet fitting (41) to engage the valve closure.

* * * * *